US012416303B2

(12) United States Patent
Bishop et al.

(10) Patent No.: US 12,416,303 B2
(45) Date of Patent: Sep. 16, 2025

(54) SYSTEMS AND METHODS FOR OPERATION MODES FOR AN AIR COMPRESSOR

(71) Applicant: Doosan Bobcat North America, Inc., West Fargo, ND (US)

(72) Inventors: Jonathan Bishop, Waxhaw, NC (US); Robert Edwards, Mt. Airy, NC (US); Brandon Ahrens, Greensboro, NC (US); Shane Dyson, Mocksville, NC (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 183 days.

(21) Appl. No.: 18/317,536

(22) Filed: May 15, 2023

(65) Prior Publication Data

US 2023/0366397 A1 Nov. 16, 2023

Related U.S. Application Data

(60) Provisional application No. 63/341,733, filed on May 13, 2022.

(51) Int. Cl.
*F04B 49/08* (2006.01)
*F04B 7/00* (2006.01)
(Continued)

(52) U.S. Cl.
CPC ..... *F04B 49/08* (2013.01); *F04B 7/0076* (2013.01); *F04B 35/04* (2013.01); *F04B 41/02* (2013.01);
(Continued)

(58) Field of Classification Search
CPC ..... F04B 35/04; F04B 7/0076; F04B 41/02; F04B 49/03; F04B 49/065; F04B 49/08;
(Continued)

(56) References Cited

U.S. PATENT DOCUMENTS 3,860,363 A * 1/1975 Silvern ..... F04B 49/225 417/295
5,820,352 A 10/1998 Gunn et al.
(Continued)

FOREIGN PATENT DOCUMENTS

DE 10 2020 121963 A1 * 2/2022
EP 1 004 774 A2 * 5/2000

OTHER PUBLICATIONS

Translation of DE-102020121963-A1, 2022.*
(Continued)

*Primary Examiner* — Charles G Freay
(74) *Attorney, Agent, or Firm* — Quarles & Brady LLP

(57) ABSTRACT

Systems and methods for a compressor system are provided for selectively operating the compressor system with reduced power consumption. An output demand level of the compressor system can be monitored over time to identify a demand profile. A pressure setpoint for the compressor system can be selectively adjusted based on the demand profile, including to selectively transition between an operational pressure setpoint for an active demand profile and a reduced pressure setpoint for an inactive demand profile.

20 Claims, 8 Drawing Sheets

(51) Int. Cl.

| | |
|---|---|
| ***F04B 35/04*** | (2006.01) |
| ***F04B 41/02*** | (2006.01) |
| ***F04B 49/03*** | (2006.01) |
| ***F04B 49/06*** | (2006.01) |
| ***F04B 49/20*** | (2006.01) |
| ***F04B 49/22*** | (2006.01) |
| ***F04C 18/16*** | (2006.01) |
| ***F04C 28/08*** | (2006.01) |
| ***F04C 28/24*** | (2006.01) |
| *F04C 29/02* | (2006.01) |

(52) U.S. Cl.
CPC ..... *F04B 49/03* (2013.01); *F04B 49/065* (2013.01); *F04B 49/20* (2013.01); *F04B 49/225* (2013.01); *F04C 18/16* (2013.01); *F04C 28/08* (2013.01); *F04C 28/24* (2013.01); *F04B 2205/063* (2013.01); *F04B 2207/01* (2013.01); *F04B 2207/042* (2013.01); *F04B 2207/043* (2013.01); *F04C 29/026* (2013.01); *F04C 2270/185* (2013.01)

(58) Field of Classification Search
CPC .. F04B 49/20; F04B 49/225; F04B 2205/063; F04B 2207/01; F04B 2207/042; F04B 2207/043; F04C 18/16; F04C 28/08; F04C 28/24; F04C 29/026; F04C 2270/185
See application file for complete search history.

(56) References Cited

U.S. PATENT DOCUMENTS

| | | | | |
|---|---|---|---|---|
| 6,077,051 | A | 6/2000 | Center et al. | |
| 9,010,459 | B2 * | 4/2015 | Field ..... | E21B 21/16 175/48 |
| 2019/0072095 | A1 | 3/2019 | Lanum et al. | |
| 2019/0145412 | A1 | 5/2019 | Jochman | |
| 2019/0154029 | A1 | 5/2019 | Jochman | |

OTHER PUBLICATIONS

Translation of EP-1004774-A2, 2000.*
International Searching Authority, International Search Report and Written Opinion from corresponding International Application No. PCT/US2023/022241 mailed Aug. 8, 2023 [10 pgs.].

* cited by examiner

SYSTEMS AND METHODS FOR OPERATION MODES FOR AN AIR COMPRESSOR

CROSS-REFERENCE TO RELATED APPLICATIONS

This application claims priority to and incorporates by reference, in its entirety, U.S. provisional patent application No. 63/341,733, filed on May 13, 2022.

BACKGROUND

The present disclosure relates rotating machines. More particularly, the disclosure relates to compressor systems (e.g. air compressor systems) that are operatively powered by a power source (e.g., an internal combustion engine) to provide pressurized fluid flow.

The discussion above is merely provided for general background information and is not intended to be used as an aid in determining the scope of the claimed subject matter.

SUMMARY

Embodiments of the invention, as generally disclosed herein, can relate to compressor systems (e.g., air compressor systems) and methods for selectively reducing the pressure in a tank of the compressor system based on an output demand level from the compressor system (e.g., a demand level from a user utilizing—or not utilizing—a tool in connection with an output of the compressor system). In some cases, a compressor system can be operated by a controller to monitor one or more operational parameters of the compressor system to determine the output demand level and selectively adjust the tank pressure accordingly, including based on monitoring output demand level over time to identify particular (e.g., active/inactive) demand profiles.

According to some aspects of the disclosure, a compressor system is provided. The compressor system can include a power source, a compressor operatively coupled to the power source. An inlet valve can selectively provide airflow to an inlet of the compressor. A tank can be in fluid communication with an outlet of the compressor, and an outlet for flow of compressed air from the tank. A control device can be configured to: determine a duration of time over which an output demand level of the compressor system is below a first demand threshold; and based upon the determined duration being greater than a time threshold, command a reduction in pressure in the tank from an operational pressure setpoint to a reduced pressure setpoint.

According to some aspects of the disclosure, a method of operating a compressor system is provided. The method can include monitoring (e.g., with an electronic control device) an output demand level of the compressor system over time to identify a demand profile. Based on the demand profile, a pressure setpoint can be commanded for the compressor system to selectively transition between an operational pressure setpoint for an active demand profile and a reduced pressure setpoint for an inactive demand profile. The reduced pressure setpoint can be substantially lower than the operational pressure setpoint.

According to some aspects of the disclosure, a compressor system can include a power source. A compressor can be operatively coupled to the power source. An electronic inlet valve can be configured to selectively provide airflow to an inlet of the compressor. A tank can be in fluid communication with an outlet of the compressor. An outlet for flow of compressed air from the tank. A control device configured to operate the electronic inlet valve to selectively move the electronic inlet valve between different positions. The control device can be configured to determine a first duration of time over which a position of the electronic inlet valve is less than a first valve position threshold. The control device can be configured to, based upon the determined first duration of time being greater than a first predetermined time threshold, command a reduction in pressure in the tank from an operational pressure setpoint to a reduced pressure setpoint.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
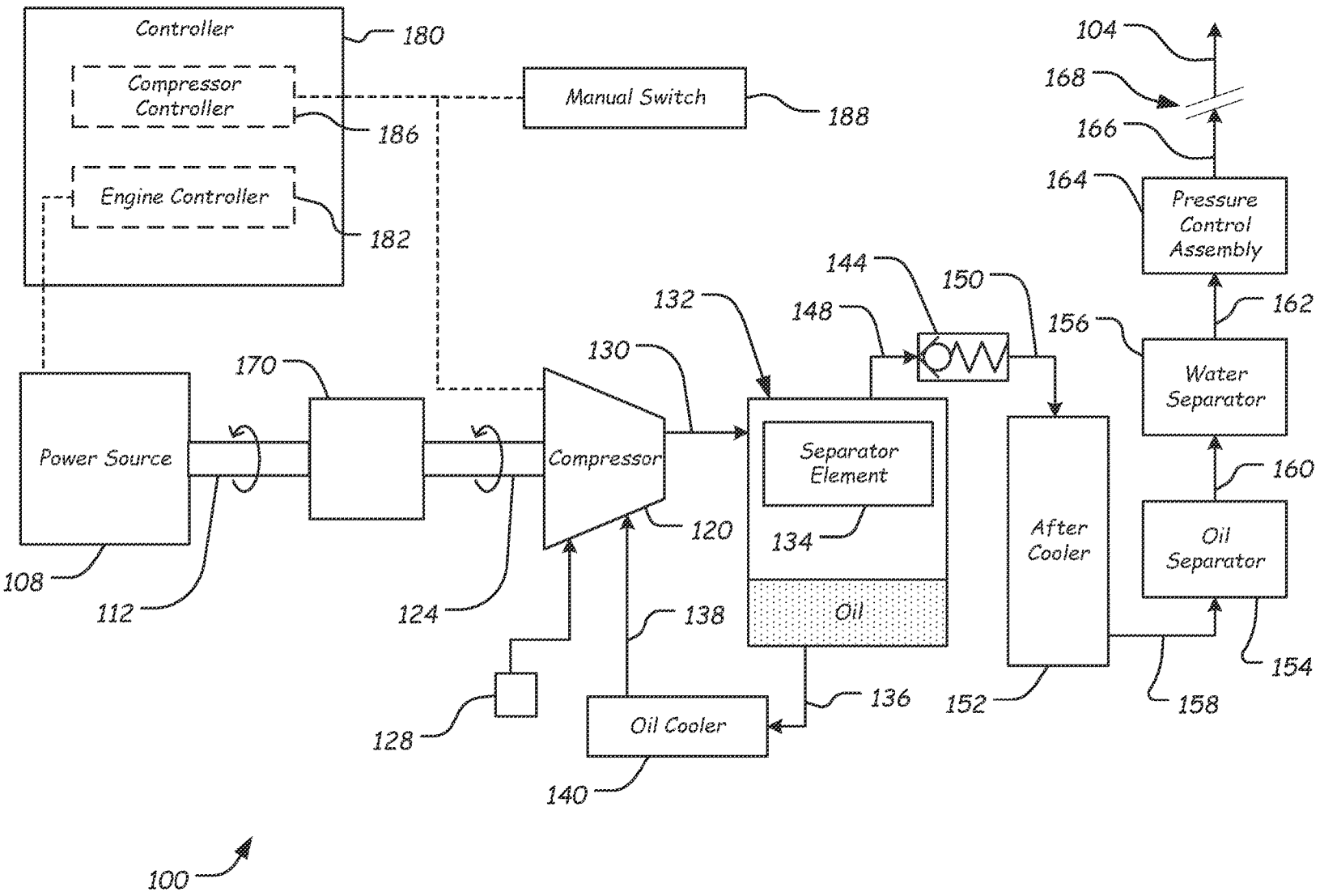
FIG. 1 is a schematic view of a compressor system having a power source coupled to a compressor, according to aspects of the disclosure.

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items Further, unless otherwise specified or limited, the terms "about" and "approximately" as used herein with respect to a reference value refer to variations from the reference value of ±5%, inclusive. Similarly, the term "substantially equal" (and the like) as used herein with respect to a reference value refers to variations from the reference value of less than ±30%, inclusive. Where specified, "substantially" can indicate in particular a variation in one numerical direction relative to a reference value. For example, "substantially less" or "substantially lower" than a reference value (and the like) indicates a value that is reduced from the reference value by 30% or more, and "substantially more" or "substantially higher" than a reference value (and the like) indicates a value that is increased from the reference value by 30% or more.

Unless otherwise noted, ranges as listed herein are inclusive of endpoints of the range. Also as used herein, unless otherwise specified or limited, "speed" refers to a rotational speed of a rotating body, as can be measured in revolutions per minute (RPM). In particular, a "speed" of an engine refers to the rotational speed of a drive shaft of the engine, as in some cases may also equal the rotational speed of one or more output shafts of the engine.

Rotating machines, for example, air compressors and pumps, can use a power source that is directly coupled to a driven component. For example, an air compressor system can include a power source with an output shaft that is directly coupled to an input shaft of a compressor (e.g., by a flexible coupling) so that the output shaft and the input shaft rotate together to power the compressor, allowing air to be compressed. In some configurations, a power source with an output shaft can be indirectly coupled to an input shaft of a compressor (e.g., by a clutch arranged between the output and input shafts) so that the output shaft and the input shaft selectively rotate together to power the compressor, allowing for selective control of air compression by activation or deactivation of the clutch. In some configurations, however, a clutch may not be included or may not be operable to decouple a compressor from a power source for certain operational modes.

When an air compressor is operatively connected to be driven by the power source (e.g., when directly coupled thereto) the power source is always under load from the compressor when rotating, even when the compressor does not need to supply any more compressed air (e.g., during times of inactivity from an operator, with an inlet valve for the compressor at a minimum flow position). This can result in increased fuel consumption and other inefficiencies. For example, on some job sites a power source can spend prolonged periods at an idle speed (e.g., 1400 RPM), maintaining an operational tank pressure (e.g., 150 psi). During times of inactivity, for example, when a tool connected with the output of the tank is not being utilized by an operator, the tank pressure applies a back pressure on the air compressor, which results in an increased load on the power source. This increased load on the power source increases the fuel consumption and thereby reduces the efficiency of the compressor system.

To provide more efficient compressor systems, some embodiments of the disclosed technology can selectively reduce tank pressure to reduce the load on a power source during times of low demand (e.g., operator inactivity), while still ensuring sufficient operational supply as needed (e.g., with rapid increase back to an operational tank pressure upon detecting tool use or other active demand profiles from an operator). Aspects of this disclosure provide systems and methods for monitoring an output demand level of a compressor system, identifying an active or inactive demand profile based on that output demand level, and selectively transitioning between operational tank pressures and reduced tank pressures to manage the load on a power source for more efficient operation.

Figure 2:
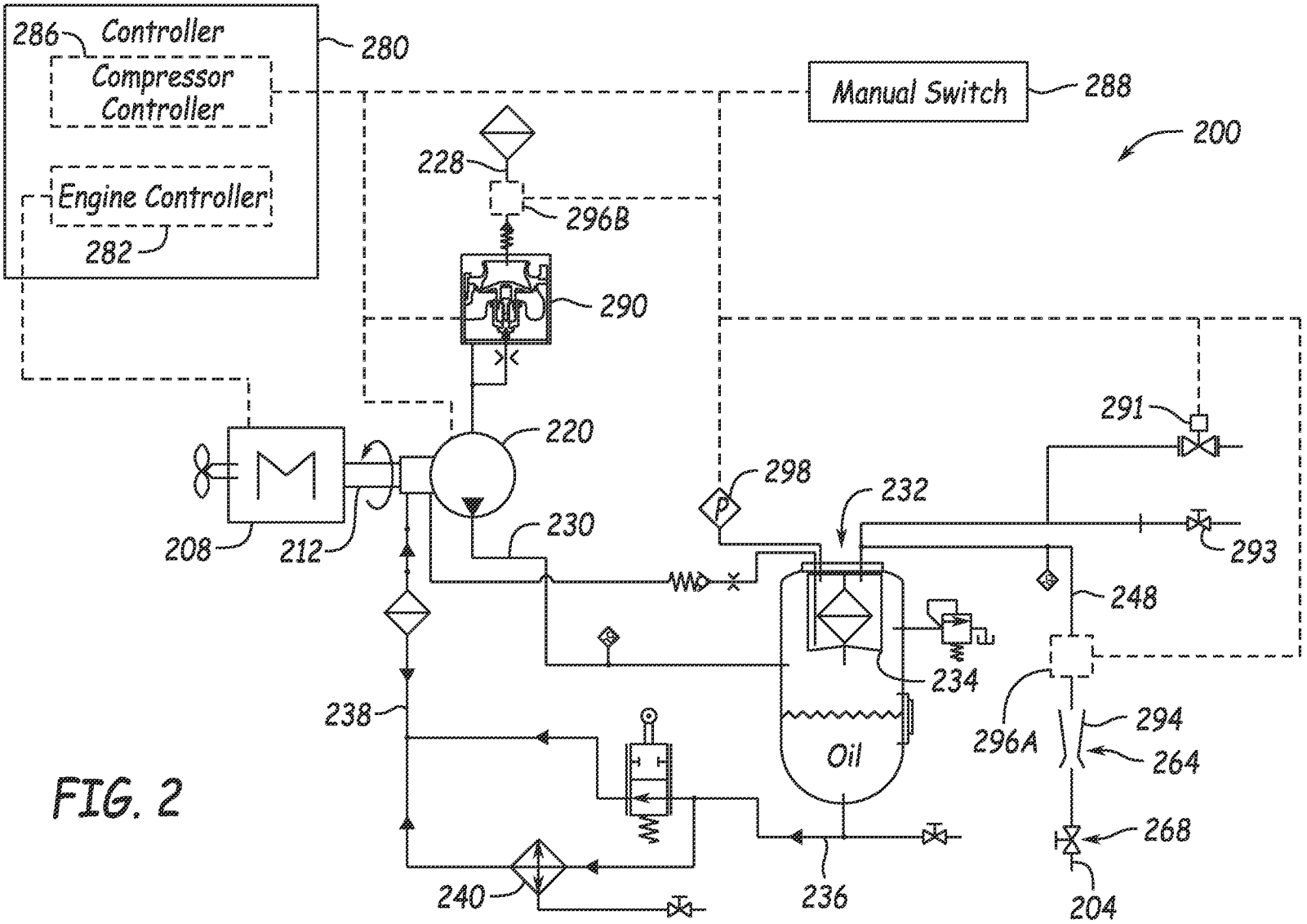
FIG. 2 is a schematic view of a compressor system having a power source coupled to a compressor, according to aspects of the disclosure.

The concepts described herein can be practiced on a variety of different types of machinery. Representative rotating machines on which aspects of the disclosure can be practiced are illustrated in FIGS. 1 and 2. The compressor systems 100, 200 is described herein are to provide a reference for understanding environments on which the embodiments described below related to compressor control systems and methods may be practiced. The compressor systems 100, 200 should not be considered limiting especially as to the description of features that the compressor systems 100, 200 may have described herein that are not essential to the disclosed embodiments and thus may or may not be included in compressor systems other than the compressor systems 100, 200 upon which the embodiments disclosed below may be advantageously practiced. Unless specifically noted otherwise, embodiments disclosed below can be practiced on a variety of rotating machines, with the compressor systems 100, 200 being only two examples of those rotating machines. For the sake of brevity, only two specific examples of rotating machines are illustrated and discussed as being representative compressor systems. However, as mentioned above, the embodiments described below can be practiced on any of a number of rotating machines, including air compressors, pumps, and the like.

FIG. 1 is a schematic illustration of the representative rotating machine configured as a compressor system 100, which can be configured to generate and discharge an air flow or another compressed gas (e.g., a refrigerant). The compressor system 100 generally includes a power source that is configured to provide power (e.g., rotational power) to a driven component. In the illustrated embodiment, the compressor system 100 is configured as an air compressor system (e.g., a single-stage air compressor system) that is configured to take in and pressurize atmospheric air to provide a pressurized air flow to a job site, via a supply line 104 (e.g., a service line). In other embodiments, a compressor system can be a multi-stage compressor system. In some cases, the compressor system 100 can be configured as a portable compressor system that can be moved between various job sites, or as a stationary (e.g., permanent) compressor system.

A compressor system can be configured to generate a pressurized air flow. For example, to compress atmospheric air and provide an air flow at the supply line 104, the compressor system 100 includes a power source configured as an engine 108 (e.g., a diesel engine or another type of internal combustion engine), although other types of power sources can also be used. The engine 108 includes and is configured to rotate an output shaft 112, for example, a crankshaft or flywheel. The output shaft 112 can be configured to provide (rotational) power to a driven device, namely, a compressor 120 (e.g., dry or oil-flooded compressor) that is configured to pressurize air and discharge an air flow. More specifically, the output shaft 112 can be coupled to an input shaft 124 of the compressor 120. Accordingly, the engine 108 can be operatively coupled to the compressor 120 so that the engine 108 powers the compressor 120. There are many different types of power-source driven compressors applicable to this disclosure. For example, the compressor 120 can be configured as a dry screw compressor, a reciprocating compressor, a centrifugal compressor, or an oil-flooded screw compressor.

With continued reference to FIG. 1, the compressor 120 can be configured as an oil-flooded screw compressor, in which oil flows around and between two counter-rotating screws to lubricate and improve sealing between components as the changing size of cells between the screws compresses the air. For example, atmospheric air can be drawn into the compressor 120 at an air inlet valve 128, to be compressed by the rotation of the screws, and then discharged from the compressor 120 as a high pressure flow at a compressor outlet 130.

During operation of the compressor 120, some of the oil may mix with the air and be carried through the compressor outlet 130. Accordingly, it can be undesirable to provide operators with an air flow that contains oil. Accordingly, for example, compressed air from the compressor 120 can pass through the compressor outlet 130 to a separator tank 132 configured to separate oil from the pressurized air with a separator element 134 (e.g., a filter or other mechanical separation element with structures to guide fluid flow or otherwise capture entrained oil droplets). Oil that is removed from the air by the separator element 134 can be drained (e.g., to an oil sump) at the bottom of the separator tank 132, while the pressurized air remains above the oil in the separator tank 132 to be provided for service on demand.

In some cases, oil that is removed from the air-oil mixture in the separator tank 132, can then be re-used to lubricate the compressor 120. In particular, the separator tank 132 can include an oil outlet 136 that allows oil from the oil sump to flow back into the compressor 120 via an oil inlet 138. In some cases, an oil cooler 140 can be disposed between the separator tank 132 and the compressor 120 to provide a cooled oil flow to the compressor 120, which can help to cool the compressor 120 and other components of the compressor system 100 by removing at least some of the heat generated by compression of air within the compressor 120. In some cases, the pressure of the air within the separator tank 132 can drive the oil flow along the return path to the compressor 120. In some cases, an oil pump (not shown) can be provided.

In some embodiments, a separator tank can also serve as a storage tank that can store pressurized air from a compressor for use when needed at a supply line. In this regard, the separator tank 132 can serve as a buffer that stores a pressurized volume of air and thereby allows the compressor system 100 to provide air flow at flow rates that are greater than those that can be provided by the compressor 120 alone. Thus, in some cases, the air within the separator tank 132 may be held at a pressure that is higher than a pressure supplied at the supply line 104. To maintain pressure within the separator tank 132, the compressor system 100 can include a minimum pressure valve 144 that is coupled to an air outlet 148 of the separator tank 132. For example, the minimum pressure valve 144 can be configured as a normally closed, spring biased check valve that only opens when the pressure of the air passing through the air outlet 148 is large enough to overcome the force of the spring or other biasing element. In some cases, the minimum pressure valve 144 can be an adjustable pressure valve. In some cases, the minimum pressure valve 144 can be configured as a sonic orifice (e.g., see FIG. 2). Additionally, the minimum pressure valve 144 can also inhibit or prevent air or other material from reversing its flow direction and entering the separator tank 132, oil cooler 140, and compressor 120 from the downstream (e.g., the supply line 104) side of the system. In other embodiments, the minimum pressure valve 144 can be provided along other points on the flow path between the separator tank 132 and the supply line 104.

In some cases, a compressor system can include additional components disposed between the compressor and a supply line to remove additional contaminants (e.g., water and oil) from the air flow. For example, as illustrated in FIG. 1, the compressor system 100 includes an aftercooler 152 that is coupled with an outlet 150 of the minimum pressure valve 144. The aftercooler 152 is a heat exchanger that cools the air to remove heat produced during compression. Consequently, as the air cools within the aftercooler 152, the air approaches its dew point, which causes moisture to condense out of the air. Additionally, the compressor system 100 can also include an oil separator 154 (e.g., a filter) and a water separator 156 to further remove oil and water from the service air flow. As illustrated in FIG. 1, service air can flow from an outlet 158 of the aftercooler 152 to the oil separator 154 and then from an outlet 160 of the oil separator 154 to the water separator 156. In other embodiments, the aftercooler 152, the oil separator 154, and the water separator 156 can be arranged differently, or in other combinations.

Prior to exiting the compressor system 100 at the supply line 104, the air can pass from an outlet 162 of the water separator 156 and through a pressure control assembly 164. The pressure control assembly 164 can be configured to control a pressure of the air flow that is provided to the supply line 104 (e.g., a supply pressure of the compressor system 100) at a connection point 166 (e.g., a hose connector or other structure). Accordingly, pressurized air from the compressor system 100 can pass from the compressor 120 to the supply line 104, via an outlet 168 of the pressure control assembly 164, when the supply line 104 is coupled to the connection point 166. The pressure control assembly 164 may be an adjustable pressure control assembly that can be manipulated by a user to supply a desired air pressure at the supply line 104.

In some embodiments, the compressor system 100 can include a coupling device configured as a clutch 170 that is disposed mechanically between the engine 108 and the compressor 120. In particular, the clutch 170 is coupled to both the engine 108 (e.g., at the output shaft 112) and the compressor 120 (e.g., at the input shaft 124) and is configured to move between a disengaged configuration and an engaged configuration. In the disengaged configuration, the output shaft 112 and the input shaft 124 are decoupled from one another so that the engine 108 does not power the compressor 120 (e.g., torque is not transferred between the output shaft 112 and the input shaft 124). Accordingly, the output shaft 112 and the input shaft 124, and the shafts 112, 124 can rotate independently of one another. The clutch 170 can be any of a number of coupling devices that are configured to selectively couple two rotating bodies together. For example, the clutch 170 can be configured as an electromagnetic friction clutch having a drive member that is configured to selectively couple with and power rotation of a driven member. In other embodiments, however, other clutch configurations can be used. For example, a clutch can be configured as a radial clutch, wherein a drive member or a driven member move along a radial direction relative to one another to move between the disengaged configuration and the engaged configuration.

Continuing, the compressor system 100 can further include a controller 180 (e.g., a control device or system) that can be configured to control one or more operational parameters of the compressor system. For example, the controller 180 of the compressor system 100 can be configured to control a rotational speed of the output shaft 112 (e.g., via electronic control of a speed of the engine 108), the engagement and disengagement of the engine 108 with the compressor 120 (e.g., via electronic control of the clutch 170), and the opening and closing of the air inlet 128 of the compressor 120 (e.g., via control of an on-off or proportional valve), among other aspects including monitoring of operational parameters and controlling an active/inactive state of the compressor, as will be described.

The controller 180 or other control devices for the operations disclosed herein can be implemented as one or more known types of processor devices (e.g., microcontrollers, field-programmable gate arrays, programmable logic controllers, logic gates, etc.), including as part of general or special purpose computers. In addition (or alternatively), the controller 180 or other control devices for the operations disclosed herein can include or be in communication with other generally known computing components, including memory, input devices, output devices, etc. (not shown), as appropriate. In this regard, the controller 180 or other control devices can be configured to implement some or all of the operations of the control processes described herein, which can, as appropriate, be executed based on instructions or other data retrieved from memory. In some embodiments, the controller 180 or other control devices can include multiple individual control devices (or modules) that can be integrated into a single component or arranged as multiple separate components that are configured to operate together to control relevant operations. In some embodiments, the controller 180 or other control devices can be part of a larger control system and can, accordingly, include or be in electronic communication with a variety of control modules, for example, engine controllers, clutch controllers, compressor controllers, hub controllers, etc. For example, as illustrated in FIG. 1, the controller 180 may include one or more of a dedicated engine controller 182, a dedicated compressor controller 186, or various other control modules.

Generally, the controller 180 can be configured to control the compressor system 100 in response to a user input, or in response to or otherwise based on one or more operational parameters of the compressor system (e.g., as sensed by various sensors on or around a compressor system, or predetermined and stored in memory). For example, the compressor system 100 can include user interfaces such as control panels, displays (including touchscreen displays), switches, buttons, and control levers, among others. In the illustrated embodiment, the compressor system 100 can include a manual switch 188 for manually transitioning the compressor system into or out of an economy mode, and the controller 180 can monitor the position or state of the manual switch 188, as will be described. Correspondingly, as also discussed above, the controller 180 can operate to monitor or control a speed of the power source 108 or to monitor or control the state of the air inlet valve 128.

The controller 180 can also be configured to monitor one or more operational parameters of the compressor system, including various temperatures, pressures, or speeds of various equipment of the relevant system, and to control other operations accordingly. For example, the controller 180 can be configured to increase an engine speed to maintain a supply pressure at the supply line 104 as indicated by a pressure gauge (or otherwise). Conversely, the controller 180 can reduce an engine speed when a lower air flow is needed to maintain a supply pressure at the supply line 104, such as when no air is flowing from supply line, but the separator tank 132 is not at an operational pressure (e.g., the compressor system 100 is filling the separator tank 132). For example, the engine 108 may be at a first engine speed that is between 1,000 RPM and 1,600 RPM, or more particularly, approximately 1,200 to 1,400 RPM, which may correspond with a high-idle speed of the engine 108 for maintaining an operational pressure within the tank 132. The engine 108 may receive a first engine speed signal from the controller 180 (e.g., the engine controller 182) to reduce the engine speed to a lower, second engine speed that is, for example, between 500 RPM and 1,000 RPM, thereby reducing the compressor output to reduce the pressure in the tank 132.

Additionally, the air inlet 128 can be monitored and controlled by the controller 180. For example, the air inlet 128 of the compressor 120 can be closed or opened (or in any position between closed and open) based on the output demand on the compressor system 100. In some cases, the controller 180 (e.g., a compressor controller 186) can be configured to send an inlet position signal (e.g., an open signal or a closed signal) to an electronic inlet valve (see FIG. 2) on the air inlet 128 of the compressor 120 based on one or more (operational) parameters.

FIG. 2 illustrates a compressor system 200 including an electronic inlet valve 290, which is another particular example of a compressor system for which the methods discussed below can be advantageously employed. In some examples, the compressor system 200 can be a particular implementation of the compressor system 100. In this light, features of the compressor system 200 described below include reference numbers that are generally similar to those used in FIG. 1. For example, the compressor system 200 is described as having a compressor 220, just as compressor system 100 has a compressor 120. Thus, discussion below generally focuses on features of the compressor system 200 that differ from the compressor system 100.

As illustrated in FIG. 2, the compressor 220 is directly coupled to the engine 208 via an output shaft 212 (e.g., in a clutch-less system), although other embodiments can include indirect couplings, as also noted above. Further, the compressor system 200 includes an electronic inlet valve 290 and a system pressure control device 291 that are in communication with the controller 280 (e.g., with a compressor controller 286 and an engine controller 282). The electronic inlet valve 290 is arranged at the air inlet 228 of the compressor 220, and the system pressure control device 291 is in fluid communication a tank 232 with a separator element 234 and, in particular, arranged on the air outlet 248 to selectively vent tank pressure to atmosphere. The controller 280 (e.g., via the compressor control module 286) can monitor the positions of the electronic inlet valve 290 and the system pressure control device 291 and, if needed, provide control signals to command a change in the position of the inlet valve 290 or the system pressure control device 291 (or other relevant state or setting, generally). With regard to changes in inlet valve position, as discussed herein, discussion of first position that is "greater" or "less" than a second position (and the like) indicates that the first position allows for, respectively, a greater or lesser air flow rate across the inlet valve for a given pressure drop.

As one example, in the illustrated embodiment of FIG. 2, the system pressure control device 291 is a solenoid-operated block valve 291 (e.g., a blowdown valve) arranged to control release of air (and pressure) from the tank 232. Thus, as controlled by the controller 280, the block valve 291 (or other valves of known types arranged with similar effect) can selectively reduce the pressure of the tank 232 by venting air from the compressor system 200, or can increase the pressure in the tank 232 by constricting (e.g., blocking) the release of compressed air from the tank 232. Further, a manual valve 293 for manual pressure relief can be provided in parallel. In particular, referring still to FIG. 2, the controller 280 is in communication with the block valve 291 and can thus be configured to cause the block valve 291 to open and close (e.g., by various incremental amounts that correspond to various levels of flow through the block valve 291 or pressures within the tank 232). In other embodiments, the system pressure control device 291 can be arranged differently. For example, the system pressure control device 291 can be arranged along the outlet 230 of the compressor 220 or in other locations. In other embodiments, as generally noted above, the system pressure control device 291 can include one or more other valves of types generally known in the art and can be disposed at other locations.

The compressor system 200 can also include a tank pressure sensor 298 in communication with the controller 280. The tank pressure sensor 298 can be utilized to monitor the tank pressure, to aid in the control of the compressor system 200 to maintain or change tank pressure settings. For example, in some embodiments, the tank pressure can be maintained by maintaining the inlet valve 290 in a near-closed position (e.g., open less than 10 percent of full-open) and the block valve 291 can also be in a near-closed position (e.g., open to substantially match the flow of the near-closed inlet valve 290) to allow for a marginal amount of air to pass through the compressor system 200 (e.g., as "idle air flow" to avoid unwanted vibration). According to some embodiments, the compressor system 200 can include a flow rate sensor 296A, 296B in communication with the controller 280. The flow rate sensor 296A can be arranged on the air outlet 248 of the tank 232 to monitor the flow rate of air leaving the tank 232. In other embodiments, the flow rate sensor 296B can be arranged on the air inlet 228 of the tank 232 to monitor the flow rate of air entering the tank 232.

In the illustrated embodiment, the compressor system 200 can also include a sonic orifice 294 arranged on the air outlet 248 of the tank 232 (e.g., as part of a pressure control assembly 264 leading to a service outlet 268). The sonic orifice 294 is configured to provide a backpressure upstream of the sonic orifice 294 that is sufficient to maintain a minimum operating pressure within the tank 232 at the maximum output flow of the compressor 220. This can ensure positive oil flow from an outlet 236 of the tank 232 to the oil inlet 238 of the compressor 220 (e.g., via an oil cooler 240) to maintain lubrication of the compressor components, particularly in oil-flooded screw compressors such as the compressor 220 shown in FIG. 2. In some embodiments, a leakage orifice (not shown) can be provided to continually vent pressure from the tank at a relatively low leakage rate and the electronic inlet valve 228 can be controlled to provide make-up air as appropriate (e.g., may generally remain at least partly open during operation of the compressor 220).

To reduce a load on the engine 208 and thereby improve engine efficiency, some embodiments can include methods for operating compressor systems (e.g., the compressor system 200) to selectively (and temporarily) reduce the pressure in the tank 232 below operational pressure while also ensuring appropriate delivery of service air.

Figure 3:
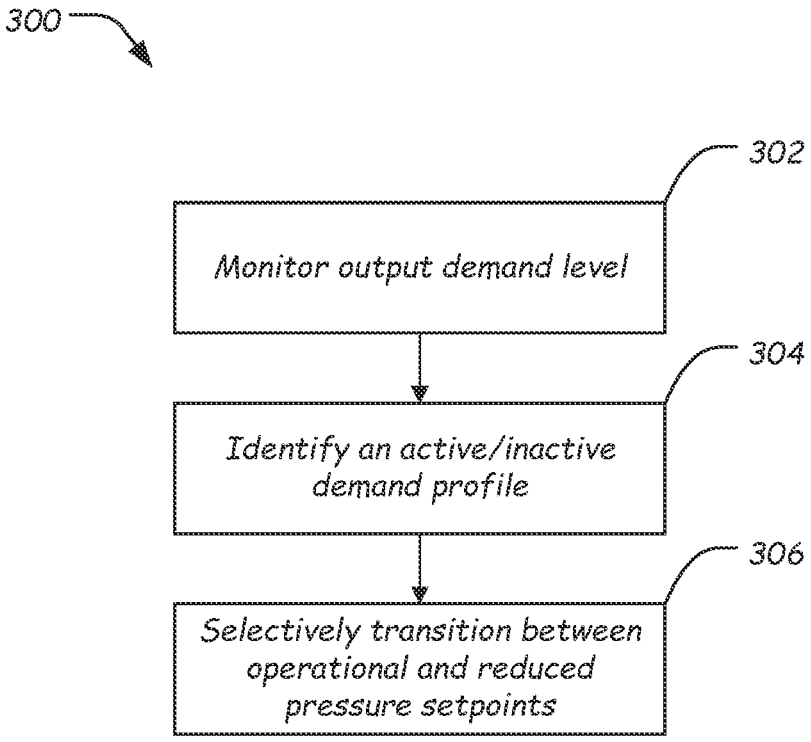
FIG. 3 is a flowchart of a method of operating a compressor system based on output demand levels, according to aspects of the disclosure.

Referring to FIG. 3, for example, a method 300 of operating the compressor systems 100, 200 to selectively reduce the pressure in the tank 232 based on output demand is illustrated. While the method 300 is described with reference to the compressor system 200 discussed above, the method can also be used with the compressor system 100 as illustrated in FIG. 1, as well as other types of rotating machines. Additionally, operations of the method 300 (and other methods discussed herein) need not be carried out in the specific order discussed below and, in some cases, may be implemented with other control devices and systems not explicitly described herein.

As illustrated in FIG. 3, the controller 280 is configured to monitor an output demand level of the compressor system 200 at block 302. The output demand level is a measurable or derivable value representative of the demand being requested from compressor system 200 by an operator, and can be based on one or more operational parameters of the compressor system 200 obtained via integrated sensors, operator inputs, or otherwise (e.g., as variously discussed above). In different embodiments, an output demand level can be a flow rate, a pressure (or pressure differential), a valve position or other valve state correlated to a flow rate or a pressure drop (e.g., as represented by a voltage or current level of a valve control signal), or various other values representative of a demand from an operator for delivery of compressed air from the compressor system 200 (e.g., a signal from operator engagement with an input device). In some embodiments, a tool can be connected to the supply line 204 of the compressor system 200, and the operator of the tool can indicate demand for air to be output by the compressor system 200 by usage of the tool, with corresponding changes in system pressures, states of one or more valves, etc.

In some embodiments, the output demand level can be determined based on a position of the inlet valve 290 (e.g., may be a scaled value between 0 and 1 proportional to a relative position of the inlet valve 290 between fully opened and fully closed). For example, during usage of a tool in connection with the compressor system 200, the inlet valve 290 can move from a closed position towards an open position to supply air to the compressor 220 to replenish utilized air that was stored in the tank 232 and delivered to power the tool in order to maintain tank pressure. An output demand level can thus move from a minimum towards a maximum. According to another example, while a tool is not being utilized, the inlet valve 290 can be in a closed position (or near a closed position), and an output demand level can thus be at a minimum.

According to other embodiments, the demand level can be determined based on tank pressure. For example, the pressure sensor 298 can monitor the pressure in the tank 232, and when a tool is being utilized, the tank pressure sensor 298 can detect a drop in the tank pressure. Thus, the pressure level in the tank 232 (or change thereof) can be inversely correlated to an output demand level of the compressor system 200.

According to some embodiments, the demand level can be determined based on a flow rate of air leaving the tank 232 in response to a customer demand. For example, the flow rate sensor 296A can monitor the amount of air leaving the system during operation of a tool powered by the compressor system 200. In other embodiments, a differential pressure across the tank 232 can be used to monitor flow rate. Thus, the flow rate of air leaving the tank 232 can be correlated to an output demand level of the compressor system 200.

According to some embodiments, the demand level can be determined based on a flow rate of air entering the tank 232 in response to a customer demand. For example, the flow rate sensor 296B can monitor the amount of air entering the system during operation of a tool powered by the compressor system 200. Thus, the flow rate of air entering the tank 232 can be correlated to an output demand level of the compressor system 200.

At block 304, based on the output demand level (e.g., as determined and recorded at block 302), the controller 280 can identify a type of demand profile and in particular, whether a present (or recent) demand profile is an active or an inactive demand profile. An active demand profile correlates to an operator using a tool or otherwise drawing operational pressurized flow from the tank 232, whereas an inactive demand profile correlates to an operator not using a tool or otherwise not drawing operational pressurized flow from the tank 232 (e.g., not drawing pressurized flow for large durations of time). For example, as will be described, the controller 280 can monitor the output demand level over time utilizing one or more of the operational parameters described above to determine whether the compressor system 200 is being actively utilized to provide operational pressurized flow. If the compressor system 200 is not being actively utilized, the controller 280 may identify that the demand profile is an inactive demand profile. Conversely, if the compressor system 200 is being actively utilized to power a tool, the controller 280 may identify that the demand profile is an active demand profile.

Based on the identified demand profile, the controller 280 can then, at block 306, selectively transition the compressor system 200 into and out of an economy mode by transitioning between a reduced pressure setpoint and an operational pressure setpoint, respectively, for control of the tank pressure. Generally, a reduced pressure setpoint is substantially lower than an operational pressure setpoint, so that the corresponding back pressure on the compressor and the associated loading of the power source can be significantly reduced. For example, a value of the reduced pressure setpoint can be 25% to 50% of a value of the operational pressure setpoint. According to some embodiments, the operational pressure setpoint defines a tank pressure above about 80 psi. According to some embodiments, the operational pressure setpoint defines a tank pressure above about 100 psi. According to some embodiments, the operational pressure setpoint is between about 100 psi and about 200 psi. In some embodiments, the operational pressure setpoint is between about 100 psi and about 750 psi. In some embodiments, the operational pressure setpoint is about 150 psi.

According to some embodiments, the reduced pressure setpoint defines a tank pressure below 100 psi. According to some embodiments, the reduced pressure setpoint defines a non-zero tank pressure (e.g., a pressure that is above atmospheric pressure). According to some embodiments, the reduced pressure setpoint is between 25 psi and 100 psi, and in some embodiments, between 25 psi and 50 psi. According to some embodiments, the reduced pressure setpoint can define a minimum operational pressure for the compressor system 200. For example, a minimum operational pressure of a compressor system 200 can be a pressure that ensures positive oil flow from the tank 232 to the oil inlet 238 of the compressor 220, as driven by the pressurized air in the tank 232. As generally discussed above, such a flow can maintain lubrication and cooling of the compressor components, particularly in oil-flooded screw compressors such as the compressor 220 shown in FIG. 2.

In different implementations, a controller can control a transition between operational and reduced pressure setpoints in various ways. In some embodiments, a controller can control one or more inlet or outlet valves (e.g., inlet valve 290 and block valve 291, see FIG. 2) to regulate flow into or out of a tank and thereby control tank pressure. For example, to transition from an operational pressure setpoint to a reduced pressure setpoint, the controller 280 can command the block valve 291 to an open position, while simultaneously commanding the inlet valve 290 to a closed position to rapidly decrease the pressure in the tank to the reduced pressure setpoint. In some embodiments, a controller can control operation of a compressor or a power source to also reduce pressure (e.g., can reduce a speed of a power source).

Figure 4:
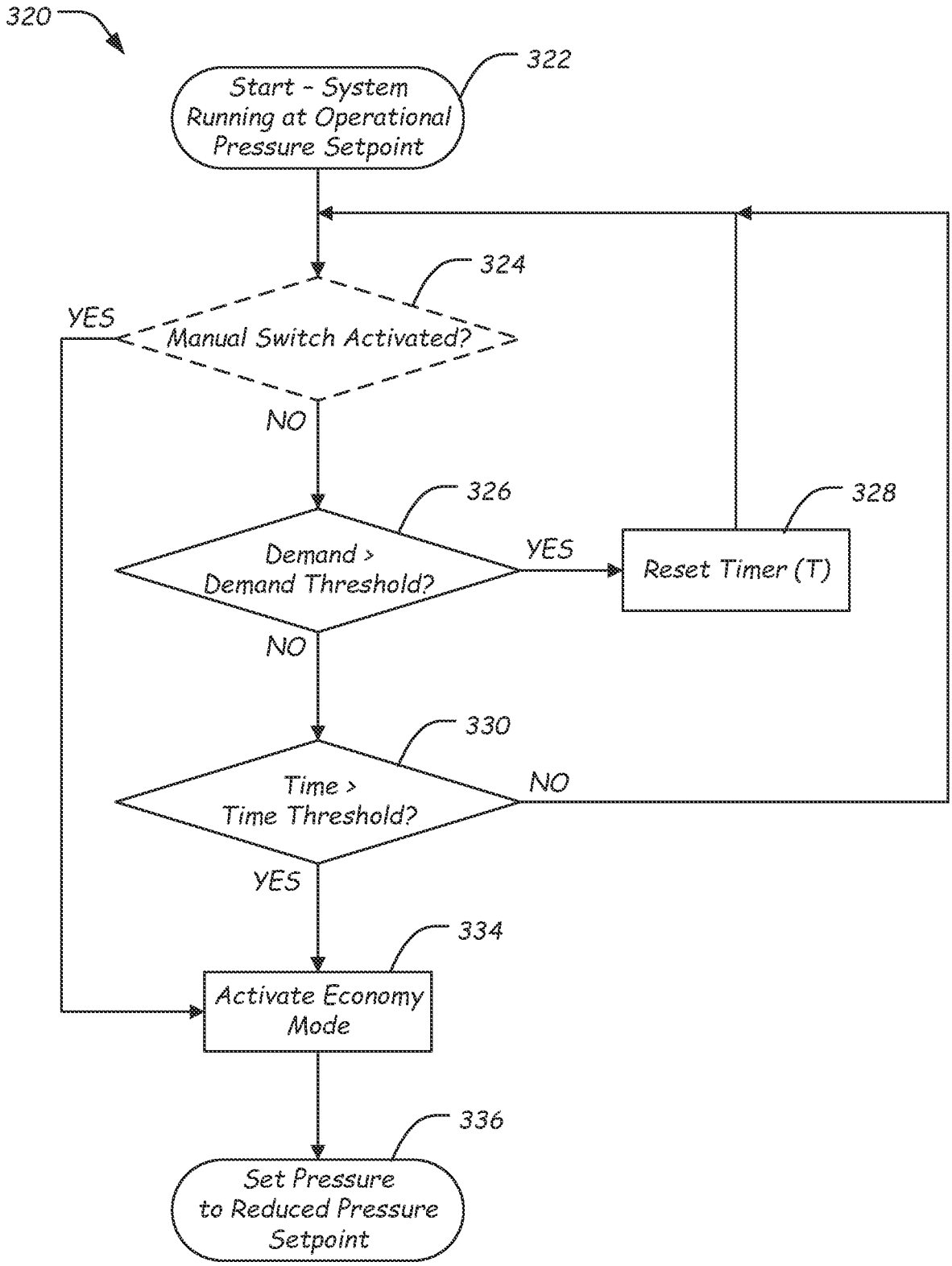
FIG. 4 is a flowchart of a first method of placing a compressor system into an economy mode based on output demand levels, according to aspects of the disclosure.

FIG. 4 illustrates a method 320 of transitioning the compressor system 200 into an economy mode with a reduced pressure setpoint, which can be implemented as part of or in conjunction with the method 300 in some embodiments. The method 320 can begin at block 322 with the compressor system 200 operating at an operational pressure setpoint. Simultaneously (or otherwise), the controller 280 can start an internal counter for a time (T) such that operational events can be linked to instances in time, including as will be described below. Optionally, the method 320 can proceed to block 324, where the controller 280 can check the status of an operator input (e.g., the manual switch 288 of FIG. 2, as described below). For example, an activated state of the manual switch 288 indicates that an operator is manually requesting that the compressor system 200 go into an economy mode, and the method 320 proceeds to block 334. At block 334, the controller 280 activates economy mode and commands a reduction in pressure in the tank 232 from the operational pressure setpoint to the reduced pressure setpoint at block 336. If the controller 280 determines that the manual switch 288 is not activated, then the method 320 can proceed to block 326 (as further discussed below).

In some embodiments, an operator input can indicate other parameters for implementation of the method 320, including setpoint pressures, time thresholds, demand thresholds (e.g., pressure thresholds, flow rate thresholds, or valve position thresholds), and so on. In some examples, the method 320 may also (or alternatively) include determining whether the manual switch 288 has been activated, and may not proceed to block 326 (or block 336) unless the switch 288 has been activated (i.e., unless an operator has indicated that economy mode is presently permitted or requested). In other words, in some cases, an operator input can serve as a prerequisite condition for entering economy mode, without necessarily being a sufficient condition for entering economy mode.

At block 326, the controller 280 can determine if the output demand level satisfies a first criteria (e.g., is greater than a first demand threshold as described below). For example, when the electronic inlet valve 290 is automatically operated to respond to operator demand, the controller 280 can monitor the position of the electronic inlet valve 290 and determine if the valve position is greater than a valve position threshold (e.g., if the valve 290 is more open than a valve position threshold). For example, the valve position threshold can be between about 30 to 50 degrees open (e.g., relative to a fully-closed valve position). Generally, a valve position can be represented with various operational parameters, including as a voltage or current level or a signal from a position or orientation sensor, which can be compared by a control device with corresponding threshold values, as appropriate. If the output demand level is greater than the first demand threshold (or otherwise satisfies the first criteria), as corresponds to actively operator demand for pressurized air, the compressor system 200 maintains the tank pressure at the operational pressure setpoint. In this instance, the method 320 can proceed to block 328 to reset the time (T) to zero and return to block 324.

If the controller 280 determines that the output demand level satisfies the first criteria (e.g., if the valve position of the valve 290 is less than a valve position threshold), the controller 280 proceeds to block 330 to determine a duration of time over which the first criteria has been met (e.g., for how long the valve 290 has not reached the valve position threshold). This duration of time can be utilized to determine duration of time of inactivity, which in turn can characterize whether a particular period of operation corresponds to an inactive demand profile. For example, the duration of time at block 330 being less than a time threshold may indicate that demand has not been low enough for long enough to suggest an extended period of inactive demand, and the controller 280 can thus continue to allow the time (T) to increase and return to block 324. For example, an operator may be using a tool sporadically, so a demand level may not be continuously above a demand threshold but to ensure uninterrupted work operations it may still be appropriate to maintain the tank pressure at the operational pressure setting.

Alternatively, for example, if the duration of time at block 330 is greater than the time threshold, then the controller 280 can activate economy mode at block 334. Correspondingly, the controller 280 can command a reduction in pressure in the tank 232 from the operational pressure setpoint to the reduced pressure setpoint at block 336. This is because the duration of time at block 330 being greater than the time threshold may be indicative of a sufficiently long period of inactivity to indicate an inactive demand profile, and the tank pressure can thus be reduced to allow for a more efficient operation of the engine 208. That is, the comparison of the duration of time for low demand levels to a time threshold can provide an indication to the controller 280 whether service air is being actively demanded and, correspondingly, can indicate times during which the compressor system 200 can (or cannot) be operated in an economy mode without depriving operators of needed flow or pressure. In some embodiments, the time threshold is between about 1 minute and about 5 minutes. In some embodiments, the time threshold is about 3 minutes. In some embodiments, the time threshold is between about 15 seconds and about 3 minutes, or between about 15 seconds and about 5 minutes.

Figure 5:
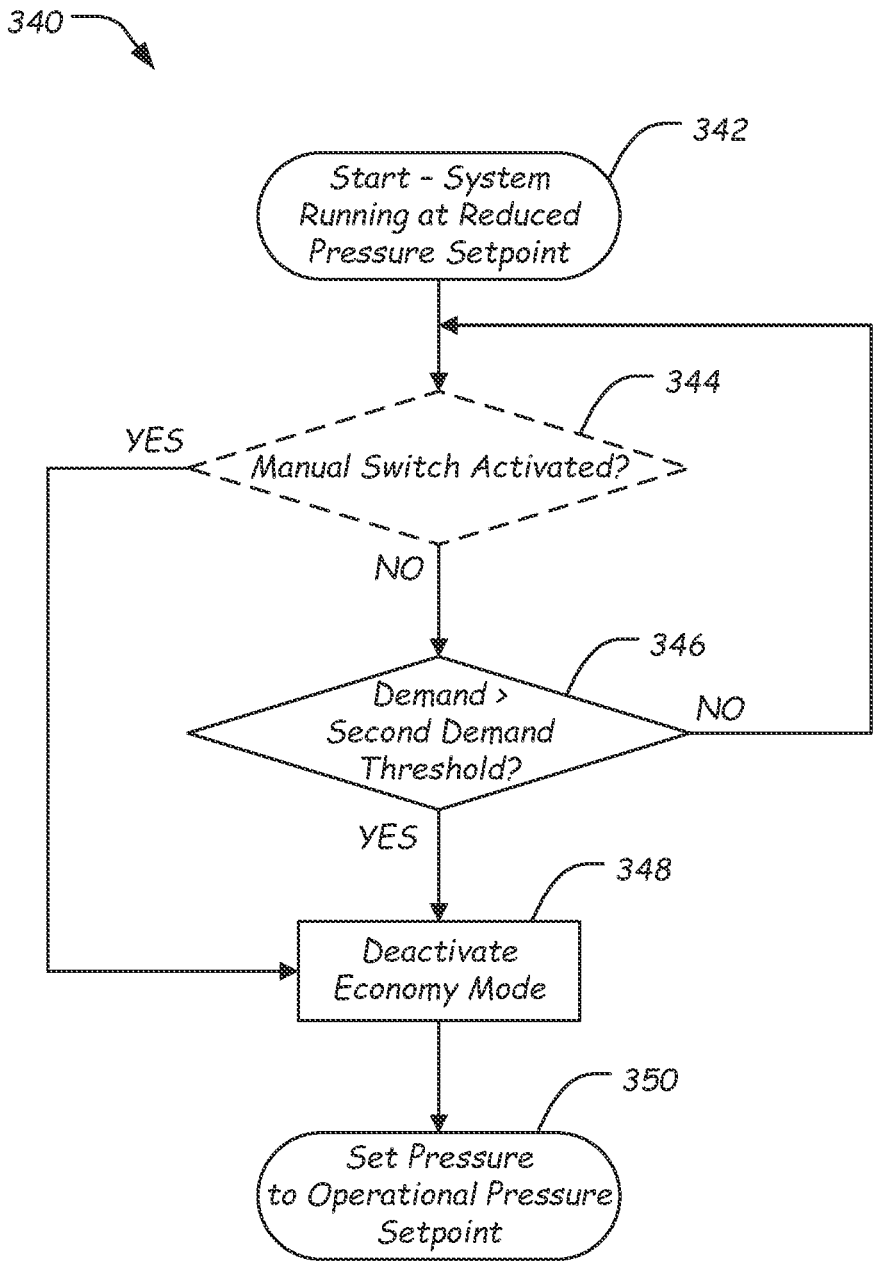
FIG. 5 is a flowchart of a method of returning a compressor system from an economy mode into an operational mode based on output demand levels, according to aspects of the disclosure.

FIG. 5 illustrates a method 340 of transitioning the compressor system 200 out of economy mode, which can be implemented as part of or in conjunction with either of the methods 300, 320 in some embodiments. The method 340 can begin at block 342 with the compressor system 200 operating at the reduced pressure setpoint (i.e., in economy mode). Optionally, the method 340 can proceed to block 344, where the controller 280 can check the status of an operator input device (e.g., the manual switch 288). The relevant input device being activated may indicate that an operator is manually requesting that the compressor system 200 exit the economy mode, and the method 340 proceeds to block 348. At block 348, the controller 280 deactivates economy mode and, at block 350, thus commands an increase in pressure in the tank 232 from the reduced pressure setpoint to the operational pressure setpoint. If the controller 280 determines that the relevant input device is not activated, then the method 340 can proceed to block 346.

At block 346, the controller 280 can determine if the output demand level satisfies a second criteria (e.g., is greater than a second demand threshold). For example, the controller 280 can determine whether the valve position of the valve 290 is more open than a second valve position threshold. If the output demand level is less than the second demand threshold (or the second criteria is otherwise not met), then a continued inactive demand profile can be identified (e.g., because an operator is not actively using a tool). Accordingly, the compressor system 200 can then maintain the tank pressure at the reduced pressure setpoint. In this instance, the method 340 returns to block 344.

If the controller 280 instead determines that the second criteria is met (e.g., that the output demand level is greater than the second demand threshold), then the controller 280 can deactivate economy mode at block 348 and command an increase in pressure in the tank 232 from the reduced pressure setpoint to the operational pressure setpoint at block 350. This is because the demand level being greater than the second demand threshold may be indicative of an operator actively using (or beginning to actively use) a tool, or otherwise demand operational pressurized air flow. Therefore, the increased demand level can indicate that the compressor system should be returned to a normal operational mode. In some embodiments, the second demand threshold is less than the first demand threshold. In other embodiments, the first and second demand thresholds can be the same threshold value. In other embodiments, the second demand threshold is greater than the first demand threshold.

Figure 6:
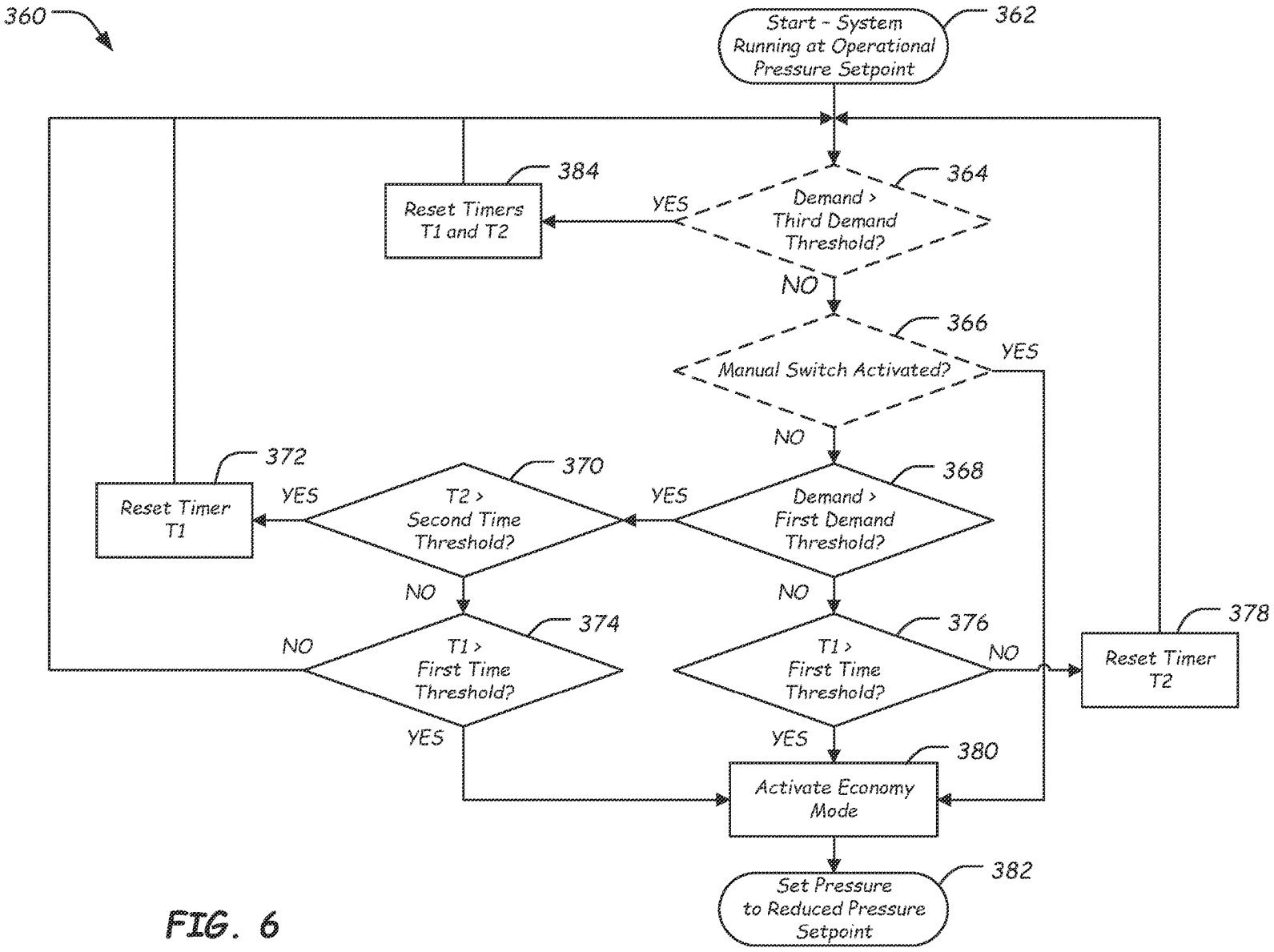
FIG. 6 is a flowchart of a second method of placing a compressor system into an economy mode based on output demand levels, according to aspects of the disclosure.

FIG. 6 illustrates a second method 360 of transitioning the compressor system 200 into an economy mode, based on monitoring of output demand levels. The method 360 can be implemented in some cases as part of or in conjunction with one or more of the methods 300, 320, 340 discussed above (e.g., as a particular implementation of the method 320). As with previous methods discussed above, although comparison to thresholds are presented as examples below, other implementations can apply other criteria to similarly control activation or deactivation of an economy mode.

The method 360 can begin at block 362 with the compressor system 200 operating at the operational pressure setpoint. In general, while the compressor system 200 is operating at the operational pressure setpoint and little to no demand is present, the intake valve can momentarily fluctuate relative to the closed position, and in some cases briefly move towards an open position (e.g., in an event with a sub-second duration), in order to maintain the tank pressure at the operational pressure setting. In these cases, it can be beneficial to distinguish between normal intake valve fluctuations and instances where an operator is creating demand (e.g., by utilizing a tool). To account for such fluctuations, in some embodiments, the controller 280 can start two internal timers, one primary (e.g., first) timer (T1) to track actual operator demands and one secondary (e.g., second) timer (T2) to track intake valve fluctuation events. Thus, as further described below, operational events can be assessed relative to relevant timings in order to allow for the controller 280 to discern between intake valve fluctuations and demand from a tool and to control operation at operational or reduced pressure setpoints accordingly.

Optionally, the controller 280 can proceed to block 364 to determine if the output demand level is greater than a third demand threshold representative of very high demand. For example, the controller 280 can monitor the position of the electronic inlet valve 290 and determine if the valve position is greater than a high-demand valve position threshold (e.g., that is larger than a first operational demand threshold). The output demand level being greater than the third demand threshold can indicate that an operator is utilizing a very high flow of air from the compressor system 200 and the compressor system 200 can thus maintain the tank pressure at the operational pressure setpoint and prevent initiation of economy mode. In this instance, the method 360 can proceed to block 384 to reset the timers (T1 and T2) to zero and return to start.

If the controller 280 (optionally) determines that the output demand level is less than the third demand threshold, the method 320 can proceed, optionally to block 366, at which the controller 280 can check the status of an operator input device (e.g., the manual switch 288). For example, if the manual switch 288 is activated, then an operator may be manually requesting that the compressor system 200 go into an economy mode, and the method 360 proceeds to block 380. At block 380, the controller 280 activates economy mode and commands a reduction in pressure in the tank 232 from the operational pressure setpoint to the reduced pressure setpoint at block 382. If the controller 280 determines that the manual switch 288 is not activated, then the method 360 can proceed to block 368.

In some embodiments, as further discussed below, an operator input device (e.g., the manual switch 288) can correspond to multiple types of operator requests relative to economy mode. For example, input at an operator input device (e.g., the manual switch 288) can provide a request to toggle between economy and normal operating modes, with an operator input (e.g., a button push) in one of the modes thus commanding the controller 280 to transition to the other.

At block 368, the controller 280 can determine if the output demand level is greater than a first demand threshold (e.g., an operational demand level). If the output demand level is greater than the first demand threshold, then the controller 280 may need to discern whether the elevated demand level is the result of normal intake valve fluctuation or instead indicates actual operator demand. For example, in the illustrated embodiment, the method 360 can proceed to block 370 to determine a duration of time that the output demand level has been above the first demand threshold using the second timer (T2). Because normal intake valve fluctuations are relatively short duration events, if the second timer (T2) is greater than a second time threshold that is relatively short (e.g., is above 0.500 seconds, 1 second, or 2 seconds), then the controller 280 can determine that the demand was not caused by normal intake valve fluctuations and is instead indicative of actual operator demand. In this case, initiation of economy mode may not be appropriate, and the controller 280 can proceed to block 372 to reset the first timer (T1) to zero and return to start. In some embodiments, the second time threshold is between about 1 second and 15 seconds. In some embodiments, the second time threshold is about 6 seconds.

If the second timer (T2) is less than the second time threshold, then the current elevated demand may not necessarily preclude initiation of economy mode. Accordingly, the first timer (T1) can continue to run, as a measure of a duration of time without active demand for service air. In some embodiments, as also shown in FIG. 6, the controller 280 can then proceed to block 374 to compare the first timer (T1) to a first time threshold, to assess the duration of time that the output demand level has been indicative of a lack of active demand (e.g., has been below the first demand threshold, other than for short duration fluctuations as tracked by the second timer (T2)). With appropriate selection of a first time threshold (e.g., 1 minute, 2 minutes, or 4 minutes), if the first timer (T1) is less than the first time threshold, then the period of inactivity from operator demands (while omitting normal intake valve fluctuations) can be determined to have not proceeded for long enough to trigger the activation of economy mode. In this case, the controller 280 can return to the start of the method 360 to continue monitoring the output demand levels and maintaining the compressor system 200 at the operational pressure setpoint.

In contrast, if the first timer (T1) is greater than the first time threshold, then the controller 280 can activate economy mode at block 380, and can command a reduction in pressure in the tank 232 from the operational pressure setpoint to the reduced pressure setpoint at block 382. In other words, the first timer (T1) reaching this duration of time without being reset may be indicative of a period of inactivity sufficiently long that the tank pressure can be appropriately reduced to allow for a more efficient operation of the engine 208.

Returning now to discussion of block 368, if the controller 280 determines that the output demand level is less than the first demand threshold (i.e., demand level is sufficiently low so as to suggest inactive operation), the controller 280 proceeds to block 376 to determine a duration of time over which the output demand level has been below the first demand threshold, again, using the first timer (T1). If the first timer (T1) is less than the first time threshold, then the controller 280 can continue to allow the first timer (T1) to increase while resetting the second timer (T2) to zero and returning to the start of the method 360. Alternatively, if the first timer (T1) is greater than or equal to the first time threshold, then the controller 280 can activate economy mode at block 380 and command a reduction in pressure in the tank 232 from the operational pressure setpoint to the reduced pressure setpoint at block 382.

In some embodiments, other processing of operational data can be implemented to assess whether increased demand levels correspond to actual operator demand. For example, a signal that indicates an output demand level (e.g., a valve position signal for monitoring intake valve position) can be filtered to attenuate the normal intake valve fluctuations while preserving indications of actual operator demand.

According to some embodiments, the demand thresholds for entering or exiting economy mode can be the same threshold. For example, the methods discussed above may include initiating economy mode when demand levels over time have been below a particular threshold for a sufficient amount of time, and exiting economy mode when demand levels then exceed that same threshold. According to other embodiments, a demand threshold for exiting economy mode can be less than a demand threshold for entering economy mode (or vice versa). According to some embodiments, a demand threshold that indicates very high demand can be larger (e.g., substantially larger) than each of the demand thresholds that correspond to entering or exiting economy mode. Further, similar relationships can also be provided between other criteria for implementation of the methods disclosed herein.

Figure 7:
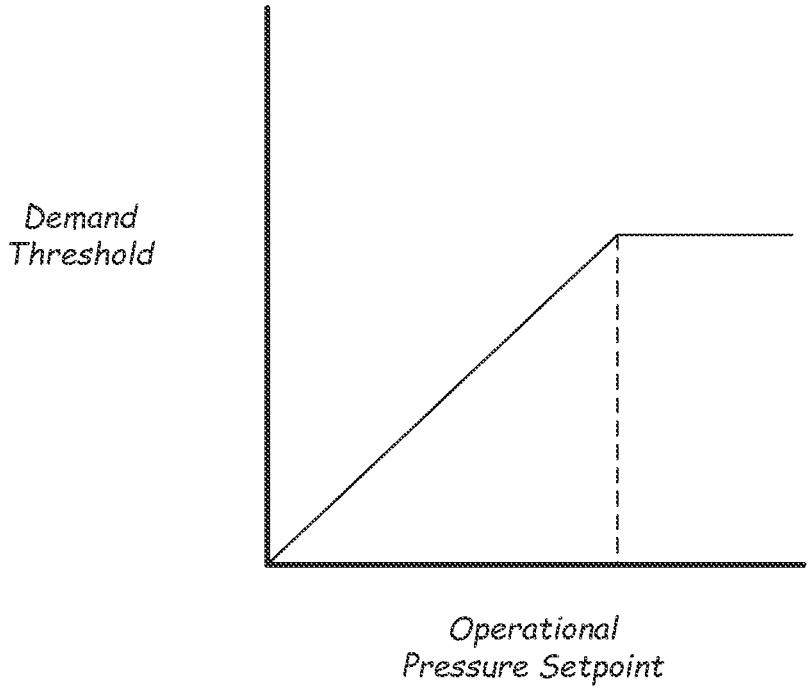
FIG. 7 is a graphical illustration of an exemplary predetermined relationship between an operational pressure setpoint and a demand threshold, according to aspects of the disclosure.

According to some embodiments, time and demand thresholds (or other criteria) can be predetermined thresholds. For example, the time and demand thresholds can be pre-set values stored in the controller 280 (e.g., in a memory thereof). In some examples, thresholds can be entered or adjusted by a user. According to some embodiments, the demand thresholds can be looked up in a stored table, or can be based on a predetermined relationship between operational pressure setpoint and demand threshold. For example, the operational pressure setpoint can generally vary depending on (e.g., to match) a desired tank pressure (e.g., 150 psi, 175 psi, etc.). In some cases, it can be beneficial to correspondingly vary the demand threshold (e.g., a threshold intake valve position) based on a specific operational pressure setpoint, including to predictably and reliably enter economy mode utilizing the methods previously described. For example, as illustrated in the example graph of FIG. 7, the demand threshold can be proportional to the operational pressure setpoint over some setpoint ranges (e.g., linearly proportional as shown). Accordingly, as the operational pressure setpoint increases, the demand threshold also increases. In some examples, the demand threshold can be constant relative to the operational pressure setting over some setpoint ranges. In the illustrated example of FIG. 7, the demand threshold can be proportional to the operational pressure setpoint until a predetermined operational pressure setpoint, after which the demand threshold is constant.

As also generally noted above, some implementations can include combinations of different aspects of the methods 300, 320, 340, 360 discussed above. In some embodiments, an integrate control system or architecture (e.g., programmed or hardwired process) can be configured to collectively control entry into and exit from economy mode. For example, the example method 400 illustrated in FIG. 8 generally combines the operations of FIGS. 5 and 6 and thus, in some cases, can be considered as another particular implementation of the method 320. In other cases, similar other combinations of the disclosed process operations may be possible (e.g., FIGS. 4 and 5).

Figure 8:
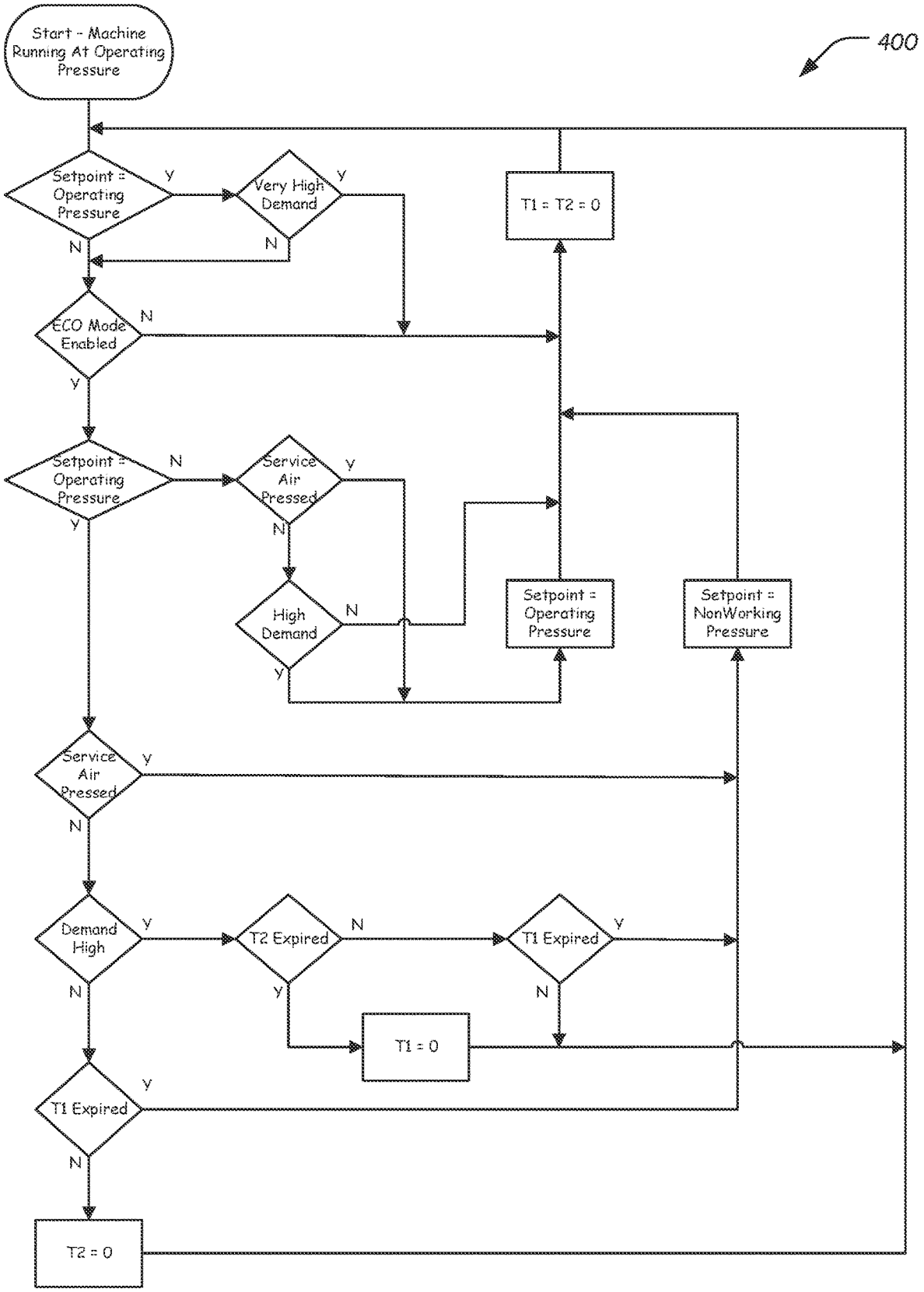
FIG. 8 is a flowchart of another method of operating a compressor system based on output demand levels, according to aspects of the disclosure.

Generally, operations under the method 400 can proceed similarly to those discussed above, with similar possible ranges of thresholds for the various illustrated decision blocks. For example, based on whether demand levels indicate a very high demand (e.g., demanded flow rates of above about 50% of the rated capacity (e.g., in cfm) of the compressor system 200), a normal operational demand (e.g., less than the very high demand), or a sufficiently extended period of inactive demand, the method 400 can variously proceed to maintain an operational pressure setpoint, to initiate economy mode and set a reduced pressure setpoint, and to exit economy mode and return to an operational pressure setpoint. In some embodiments, further operator input or other threshold conditions may also be relevant. As one example, as shown in FIG. 8, whether to proceed toward possible initiation of an economy mode can depend on whether an economy mode has been enabled. For example, an operator of a compressor system may have the option to enable economy mode via activation (or deactivation) of a particular system setting or via another input channel (e.g., a button push or other engagement with an operator input device), and the method 400 may not initiate economy mode and set a reduced pressure setpoint unless the enablement input has been received (e.g., via system setting or otherwise).

As also discussed above, some embodiments can generally analyze demand levels over time to identify a particular demand profile (i.e., a temporally extended pattern of demand that corresponds to particular demand by a consumer of the compressed air, including, for example, general "active" and "inactive" demand as discussed above, or active/inactive demand profiles corresponding to more particular states or usage/operations of the compressor system), and thereby determine whether initiating or exiting economy (or another) mode may be appropriate. In particular, some examples above discuss the use of timing considerations to qualify demand over time as corresponding to (e.g., indicating) a particular demand profile. For example, a control system can be configured to identify an inactive demand profile in response to indications of reduced demand over sufficient time (e.g., as indicated by comparison with a demand threshold, discounting non-demand fluctuations) and then initiate economy mode accordingly. Similarly, a control system can be configured to identify an active demand profile based on increases in demand level (e.g., increasing above a demand threshold while in an economy mode) and to exit or not initiate economy mode accordingly. In other embodiments, other analysis to identify particular demand profiles may be used. For example, users may enter or select characteristics of a demand profile (e.g., demand level patterns, timing considerations, etc.) and controller decisions to initiate or exit economy mode can be executed accordingly. As another example, monitoring of operational usage over time can be used to define or refine characteristics of a demand profile, so that transitions in and out of economy mode can be adaptably responsive to operational use patterns and operator or site characteristics. In another example, the controller, or an artificial intelligence system/algorithm integrated into the controller, can monitor the demand levels overtime to modify the parameters for entering or exiting economy mode.

Thus, some embodiments can provide improved compressor systems and control systems and methods for compressor systems. For example, some embodiments can improve operational efficiency by selectively transitioning into and out of an economy mode of operation based on monitoring demand levels and assessing characteristics of associated demand profiles.

In some implementations, devices or systems disclosed herein can be utilized, manufactured, installed, etc. using methods embodying aspects of the invention. Correspondingly, any description herein of particular features, capabilities, or intended purposes of a device or system is generally intended to include disclosure of a method of using such devices for the intended purposes, of a method of otherwise implementing such capabilities, of a method of manufacturing relevant components of such a device or system (or the device or system as a whole), and of a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as embodiments of the invention, of the utilized features and implemented capabilities of such device or system.

In some embodiments, aspects of the invention, including computerized implementations of methods according to the invention, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the invention can be implemented as a set of instructions, tangibly embodied on a non-transitory computer-readable media, such that a processor device can implement the instructions based upon reading the instructions from the computer-readable media. Some embodiments of the invention can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some embodiments, a control device can include a centralized hub controller that receives, processes and (re)transmits control signals and other data to and from other distributed control devices (e.g., an engine controller, an implement controller, a drive controller, etc.), including as part of a hub-and-spoke architecture or otherwise.

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the invention, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the invention. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of" For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

We claim:

1. A compressor system, comprising:
- a power source;
- a compressor operatively coupled to the power source;
- an inlet valve to selectively provide airflow to an inlet of the compressor;
- a tank in fluid communication with an outlet of the compressor;
- an outlet for flow of compressed air from the tank; and
- a control device configured to:
  - determine a duration of time over which an output demand level of the compressor system is below a first demand threshold; and
  - based upon the determined duration being greater than a time threshold, command a reduction in pressure in the tank from an operational pressure setpoint to a reduced pressure setpoint.

2. The compressor system of claim 1, wherein when the tank is at the reduced pressure setpoint, the control device is further configured to command the compressor system to increase the pressure in the tank from the reduced pressure setpoint to the operational pressure setpoint based upon the determination that the output demand level is above a second demand threshold.

3. The compressor system of claim 2, wherein the first demand threshold is the same as the second demand threshold.

4. The compressor system of claim 1, wherein the control device is further configured to determine the output demand level based on one or more of:
- a flow rate of air entering the compressor; or
- a position of the inlet valve.

5. The compressor system of claim 1, wherein the control device is further configured to determine the output demand level based on a flow rate of air exiting the tank in response to a customer demand.

6. The compressor system of claim 1, wherein the reduced pressure setpoint is below 100 psi.

7. The compressor system of claim 1, wherein one or more of: the operational pressure setpoint is between about 100 psi and about 750 psi, or the reduced pressure setpoint is above 50 psi.

8. A method of operating a compressor system that includes a power source, a compressor operatively coupled to the power source, an inlet valve to selectively provide airflow to an inlet of the compressor, a tank in fluid communication with an outlet of the compressor, and an outlet for flow of compressed air from the tank, the method comprising:

determining, with a control device, a duration of time over which an output demand level of the compressor system is below a first demand threshold; and with the control device, based on the determined duration being greater than a time threshold, commanding a reduction in pressure in the tank from an operational pressure setpoint to a reduced pressure setpoint.

9. The method of claim 8, wherein a value of the reduced pressure setpoint is less than 65 psi.

10. The method of claim 8, wherein commanding the reduction in pressure in the tank includes, with the compressor system operating at the operational pressure setpoint, commanding the compressor system, with the control device, to switch to operation at the reduced pressure setpoint based on the output demand level being, over a first predetermined duration of time:

continuously below the first demand threshold; or continuously below the first demand threshold except for a deviation to be above the first demand threshold for less than a second predetermined duration of time.

11. The method of claim 10, wherein commanding the reduction in pressure in the tank includes, with the compressor system operating at the reduced pressure setpoint, commanding the compressor system, with the control device, to switch to operation at the operational pressure setpoint based on the output demand level exceeding a second demand threshold.

12. The method of claim 10, wherein one or more of:

the second predetermined duration of time is substantially less than the first predetermined duration of time; or the reduced pressure setpoint is substantially lower than the operational pressure setpoint.

13. A compressor system, comprising:

a power source;

a compressor operatively coupled to the power source;

an electronic inlet valve to selectively provide airflow to an inlet of the compressor;

a tank in fluid communication with an outlet of the compressor;

an outlet for flow of compressed air from the tank; and a control device configured to:

operate the electronic inlet valve to selectively move the electronic inlet valve between different positions;

determine a first duration of time over which a position of the electronic inlet valve is less than a first valve position threshold; and based upon the determined first duration of time being greater than a first predetermined time threshold, command a reduction in pressure in the tank from an operational pressure setpoint to a reduced pressure setpoint.

14. The compressor system of claim 13, further comprising:

a block valve;

wherein the control device is further configured to selectively move the block valve between different positions to vent pressure from the tank; and wherein commanding the reduction in pressure in the tank includes:

commanding the electronic inlet valve to a closed position; and commanding the block valve to an open position, thereby venting pressure in the tank.

15. The compressor system of claim 13, wherein the control device is further configured to:

while determining the first duration of time, determine a second duration of time over which the position of the electronic inlet valve is greater than the first valve position threshold; and selectively, one or more of:

command the reduction in pressure in the tank to the reduced pressure setpoint in response to the determined first duration of time being greater than the first predetermined time threshold and the determined second duration of time being less than a second predetermined time threshold; or in response to the determined second duration of time being greater than the second predetermined time threshold, maintain the pressure in the tank at the operational pressure setpoint and reset a counter for the first duration of time.

16. The compressor system of claim 15, wherein the second predetermined time threshold is substantially less than the first predetermined time threshold.

17. The compressor system of claim 13, wherein when the tank is operating at the reduced pressure setpoint the control device is further configured to command the compressor system to command an increase in the pressure in the tank from the reduced pressure setpoint to the operational pressure setpoint based on determining that the position of the electronic inlet valve is greater than a second valve position threshold.

18. The compressor system of claim 13, wherein one or more of:

the operational pressure setpoint is between about 100 psi and about 750 psi; or the reduced pressure setpoint is less than 100 psi.

19. The compressor system of claim 13, wherein the compressor is an oil-flooded screw compressor.

20. The compressor system of claim 19, wherein the compressor system further includes an oil return system to return oil from the tank to the oil-flooded screw compressor and the oil return system is configured to permit pressurized oil flow from the tank to the oil-flooded screw compressor with the tank at the reduced pressure setpoint.

* * * * *